US006089203A

United States Patent [19]

Cantrell et al.

[11] Patent Number: 6,089,203

[45] Date of Patent: Jul. 18, 2000

[54] INTERNAL COMBUSTION ENGINE WITH OFFSET INTAKE VALVE SEAT FOR IMPROVED INTAKE CHARGE MOTION

[75] Inventors: Douglas David Cantrell, Ann Arbor; Mark Allen Bourcier, Plymouth; Keith Daniel Miazgowicz; Michael Bruno Magnan, both of Dearborn; Rebecca Lynne Frayne, Northville, all of Mich.

[73] Assignee: Ford Global Technologies, Inc., Dearborn, Mich.

[21] Appl. No.: 09/220,013

[22] Filed: Dec. 23, 1998

[51] Int. Cl.[7] ..... F01L 3/06

[52] U.S. Cl. ..... 123/188.14; 123/188.8; 123/306

[58] Field of Search ..... 123/306, 308, 123/188.2, 188.4, 188.8, 188.14

[56] References Cited

U.S. PATENT DOCUMENTS

| | | | |
|---|---|---|---|
| 1,512,952 | 10/1924 | Secor | 123/188.14 |
| 3,021,826 | 2/1962 | Fezzy et al. | 123/188.14 |
| 3,273,551 | 9/1966 | Julien et al. | 123/188.14 |
| 3,444,852 | 5/1969 | Henry-Biaband | 123/188.14 |
| 3,653,368 | 4/1972 | Scherenberg | 123/188.8 |
| 3,933,142 | 1/1976 | List et al. | 123/188.14 |
| 4,438,740 | 3/1984 | Slee | 123/306 |
| 4,756,281 | 7/1988 | Chen et al. | 123/188.8 |
| 4,831,976 | 5/1989 | Pozniak et al. | 123/188.8 |
| 5,551,392 | 9/1996 | Yamaji et al. | 123/306 |
| 5,634,444 | 6/1997 | Matsuki et al. | 123/306 |

FOREIGN PATENT DOCUMENTS

| | | | |
|---|---|---|---|
| 2502575 | 7/1901 | Germany | 123/188.14 |

*Primary Examiner*—Willis R. Wolfe
*Assistant Examiner*—Hieu T. Vo
*Attorney, Agent, or Firm*—Jerome R. Drouillar

[57] ABSTRACT

A reciprocating internal combustion engine uses intake valve seats which are offset from the intake port center lines such that charge motion of the inlet charge will be increased without the need for a charge motion control valve, and without causing a loss of volumetric efficiency of the engine.

9 Claims, 2 Drawing Sheets

INTERNAL COMBUSTION ENGINE WITH OFFSET INTAKE VALVE SEAT FOR IMPROVED INTAKE CHARGE MOTION

FIELD OF THE INVENTION

The present invention relates to internal combustion engines having poppet valves for intake and exhaust flow control.

DISCLOSURE INFORMANTION

Engine designers have known for a considerable length of time that it is desirable to increase intake charge motion so as to promote gas/fuel mixing, which in turn allows greater levels of exhaust gas recirculation (EGR) to be employed while avoiding degradation of combustion stability. Various schemes have been used to increase intake charge motion. One method for increasing charge motion is to provide a charge motion control valve mounted in the intake port or runner upstream of the intake valve. Unfortunately, such devices are expensive and require ancillary support equipment, such as an engine controller. And, such devices cause flow restriction even when the charge motion control valve is in its wide-open position.

U.S. Pat. No. 4,438,740 discloses a valve seat having a mask or projection which causes flow to be displaced to one side of the valve. This flow mask, however would undesirably disturb flow through the port at wide-open throttle conditions.

An offset valve seat system according to the present invention provides increased charge motion and charge energy, while minimizing the concomitant drawback of a decreased flow coefficient.

SUMMARY OF THE INVENTION

An internal combustion engine includes a cylinder, a crankshaft having a center axis, a piston slidably housed within the cylinder and attached to the crankshaft by a connecting rod, and a cylinder head. The cylinder head has an intake port formed within the head, with the port having an outlet with a generally circular inside surface having a first diameter and a port center. An intake valve seat is inset into the intake port. The valve seat has a circular inside surface with a valve center and has an inside diameter which is smaller than the first diameter or the diameter of the outlet of the intake port. The center of the intake valve seat may be either concentric with the center of the intake port or can be offset from the center of the intake port.

In the event that the intake valve seat is offset from the center of the intake port, it may be offset in a direction which is parallel to the center axis of the crankshaft or in a direction which is perpendicular to the center axis of the crankshaft. Stated another way, if the intake port has a roof and a floor, with the distance between the port roof and the center axis of the cylinder being less than the distance between the port floor and the center axis of the cylinder, the valve seat may be offset from the center of the port outlet or valve center so that tumble flow of the intake charge is reinforced either in reverse or forward tumble flow, or both. In this manner, the energy of the intake charge will be increased, thereby providing the beneficial effects previously described.

It is an advantage of the present invention that this invention produces increased charge motion and energy without the need for expensive charge motion control valve hardware.

It is a further advantage of the present invention that an engine may be tuned to have different charge motion characteristics without the need for changing the intake port configuration; all that is required is that the valve seat bore in the cylinder head's intake port be offset in a different direction.

It is a further advantage of the present invention that this invention produces charge motion on a passive basis, without the need for a control system and without absorbing excessive energy from the incoming air charge.

It is a further advantage of the present invention that this invention may be employed to aid the production of either tumble or swirl or both.

Other advantages as well as objects and features of the present invention will become apparent to the reader of this specification.

DETAILED DESCRIPTION OF PREFERRED EMBODIMENTS

Figure 1:
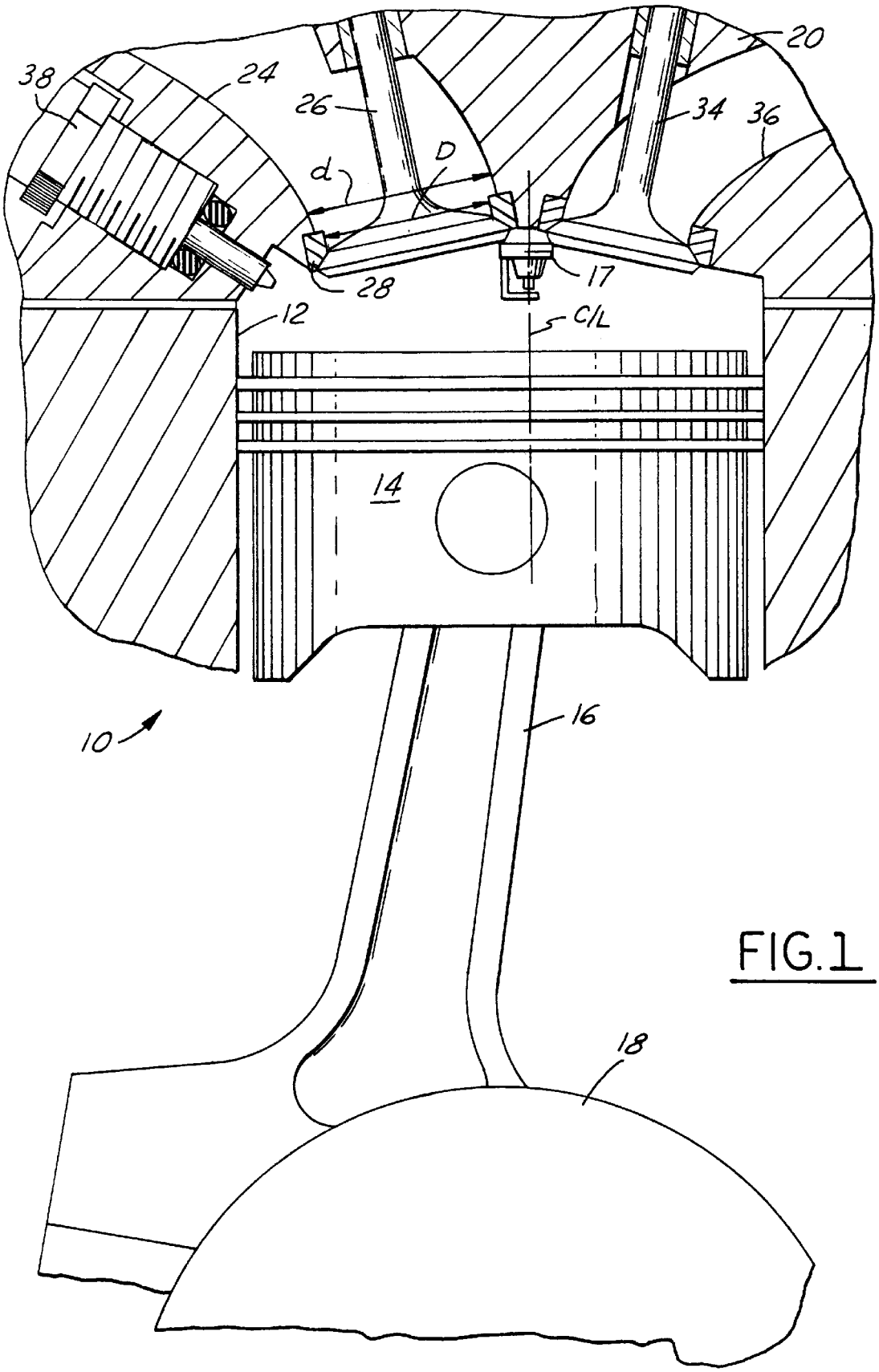
FIG. 1 is a schematic representation of an engine constructed according to the present invention and having a first intake port and intake valve seat arrangement.

As shown in FIG. 1, engine 10, having cylinder 12, has piston 14 slidingly housed therein. Piston 14 is attached to crankshaft 18 via connecting rod 16 in conventional fashion. Intake port 24 allows fresh charge to enter the combustion chamber defined by cylinder head 20, cylinder 12, and piston 14. Exhaust port 36 allows spent gases to leave the combustion chamber. Intake valve 26 allows air charge to enter the combustion chamber and exhaust valve 34 allows gases to leave the combustion chamber. Although fuel injector 38 is shown and being mounted within cylinder head 20 so as to allow fuel to be furnished directly to the combustion chamber, those skilled in the art will appreciate in view of this disclosure that a valve system according to the present invention may be employed with other types of engines having port fuel injection and other types of premixed and stratified charge diesel and spark ignition engines. Spark plug 17 fires the charge in the cylinder.

Intake valve seat 28 is mounted within the mouth, or outlet, of port 24. Port 24 has a generally circular inside surface with an imaginary center. Intake valve seat insert 28 has a circular inside surface with its own imaginary center. The circular inside surface of valve seat insert 28 has an inside diameter which is smaller than a first diameter of the intake port outlet.

Figure 4:
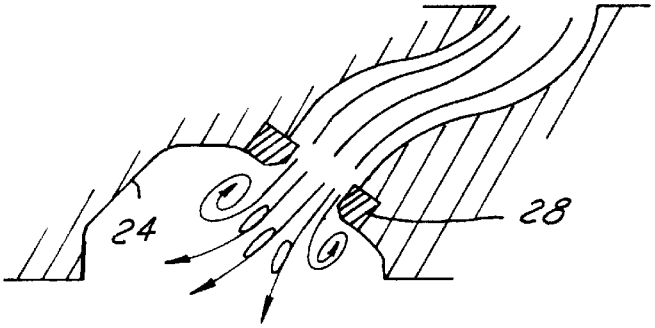
FIGS. 4, 5 and 6 illustrate intake flows resulting from the port and valve seat combinations illustrated in FIGS. 1–3.

In FIG. 1, the center of intake valve seat insert 28 is concentric with the center of the outlet of intake port 24. Because, however, the inside diameter D of intake valve seat insert 28 is less than the inside diameter of port 24, which is labeled d, vortices will be shed off the valve seat insert 28 for its entire circumference. In other words, vortices will be shed off portions of valve seat insert corresponding to both the roof and the floor of port 24, as well as from the portions of the insert extending between the roof and floor portions. This flow characteristic is shown in FIG. 4. In the interest of visual clarity, FIGS. 4–6 include only an intake port and no intake valve is shown. It is further noted that for the purposes of this specification the roof is defined as that portion of port 24 which is closer to the center line $C_L$ of cylinder 12, with the floor being defined as the portion of port 24 which is farther from the center line of cylinder 12. Vortices shedding from insert 28 disintegrate into particles having higher energy, with the result that the charge energy on a microscopic level is greatly increased. Of course, undisturbed streamlines characterize flow through the portion of the flow extending to the center of port 24 from its periphery.

The inventors of the present invention have tested the present system and have determined that this system may be employed with a port 24 having diameter d of 30 mm and a seat 28 having an inside diameter D of 28 mm without causing any appreciable flow loss. As a result, charge energy is increased, but not at the expense of the engine's volumetric efficiency. This results at least in part because the back corner of seat 28 is radiused or chamfered so as to ease the flow of air from port 24 and over the seat.

Figure 2:
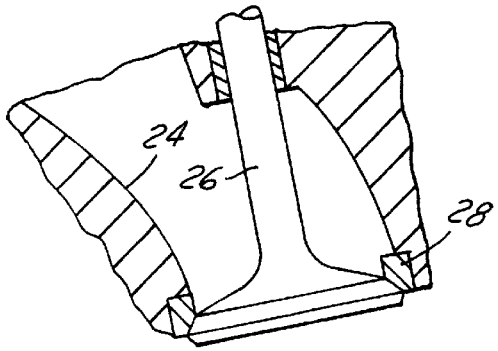
Figure 5:
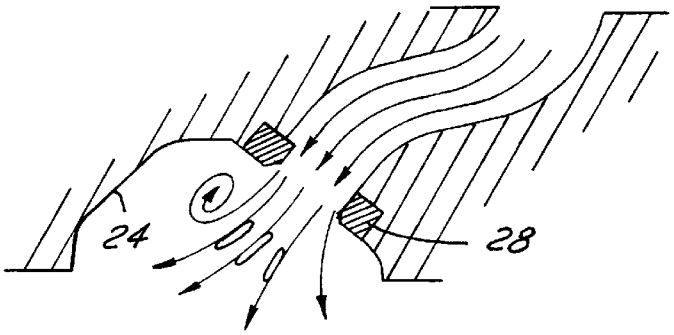

FIGS. 2 and 5 illustrate a system according to the present invention in which intake valve seat 28 is inset into intake port 24 such that the distance between the valve center and the port roof is greater than the distance between the valve center and the port floor. As illustrated in FIG. 5, this arrangement will reinforce a so-called reverse tumble flow within the combustion chamber, and is beneficial if greater energy is needed in the upper area of the combustion chamber.

Figure 3:
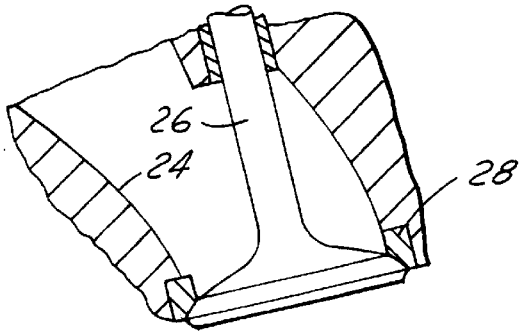
FIGS. 2 and 3 illustrate two additional configurations of an intake port and intake valve seat according to the present invention.
Figure 6:
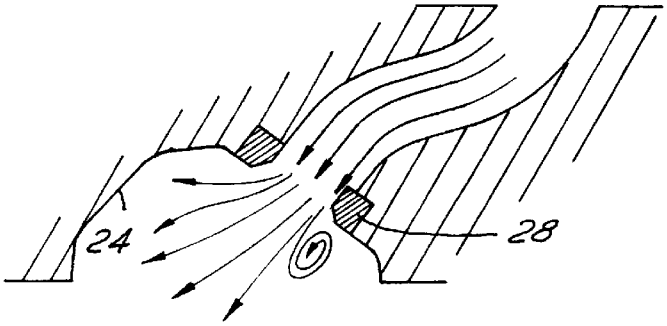

FIGS. 3 and 6 illustrate a situation wherein valve seat insert 28 is offset such that the distance between the center of valve seat 28 and the port roof is less than the distance between the valve seat center and the floor of the port. As shown in FIG. 6, this arrangement produces so-called forward tumble in the combustion chamber in a lower portion of the chamber, which will be useful for certain types of engines. Those skilled in the art will appreciate in view of this disclosure that an offset valve seat system according to the present invention may be employed in conjunction with an intake port which is of itself configured so as to increase tumble motion. In this combination, the present valve seat device will act to reinforce the tumble motion inherently produced by the port design.

According to another aspect of the present invention, a method for changing the charge motion characteristic of the intake port and combustion chamber of an engine includes the steps of determining the energy distribution of air flowing through the intake port and into the combustion chamber and selecting a portion of the combustion chamber in which increased energy is desirable. Thereafter, a valve seat insert mounted in the mouth of the intake port is offset from the geometric center of the port such that air flowing through the port is directed toward the portion of the combustion chamber in which increased energy is desired.

While the invention has been shown and described in its preferred embodiments, it will be clear to those skilled in the arts to which it pertains that many changes and modifications may be made thereto without departing from the scope of the invention.

We claim:

1. An internal combustion engine, comprising:

a cylinder;

a crankshaft having a center axis;

a piston slidably housed within the cylinder and attached to the crankshaft by a connecting rod;

a cylinder head having;

an intake port formed within the cylinder head, with said port having an outlet with a generally circular inside surface having a first diameter and a port center; and an intake valve seat inset into said intake port, with said valve seat having a circular inside surface with a valve center and having an inside diameter which is smaller than said first diameter of said intake port outlet.

2. An engine according to claim 1, wherein the center of said intake valve seat is concentric with the center of the intake port.

3. An engine according to claim 1, wherein the center of said intake valve seat is offset from the center of the intake port.

4. An engine according to claim 1, wherein the center of said intake valve seat is offset from the center of the intake port in a direction which is parallel to the center axis of the crankshaft.

5. An internal combustion engine, comprising:

a cylinder having a center axis and an upper end;

a crankshaft having a center axis;

a piston slidably housed within the cylinder and attached to the crankshaft by a connecting rod;

a cylinder head closing the upper end of the cylinder;

an intake port formed within the cylinder head, with said port having an outlet with a generally circular inside surface having a first diameter and a port center, and with said outlet further having a port roof and a port floor, with the distance between said port roof and the center axis of the cylinder being less than the distance between the port floor and the center axis of the cylinder;

an intake valve seat inset into said intake port, with said valve seat having a circular inside surface with a valve center and a diameter which is smaller than said first diameter of the intake port outlet, with said valve center being at different distances from said port roof and said port floor; and an intake valve mounted within said cylinder head so as to cooperate with said intake valve seat to control the flow of gases through the intake port.

6. An engine according to claim 5, wherein the distance between said valve center and said port roof is greater than the distance between the valve center and the port floor.

7. An engine according to claim 5, wherein the distance between said valve center and said port roof is less than the distance between the valve center and the port floor.

8. An engine according to claim 5, wherein the center of said intake valve seat is offset from the center of the intake port in a direction which is parallel to the center axis of the crankshaft.

9. A method for changing the charge motion characteristic of an intake port and a combustion chamber of an engine, comprising the steps of:

determining the energy distribution of air flowing through the intake port and into the combustion chamber;

selecting a portion of a combustion chamber in which increased energy is desirable; and offsetting a valve seat insert mounted in the mouth of the intake port from the geometric center of the port such that air flowing through the port is directed toward the portion of the combustion chamber in which increased energy is desired.

* * * * *